United States Patent [19]

Herr et al.

[11] 4,214,539

[45] Jul. 29, 1980

[54] POSITION SENSING DEVICE FOR ELECTRONIC SEWING MACHINE

[75] Inventors: John A. Herr, Garwood; Wolfgang Jaffe, Roselle Park, both of N.J.

[73] Assignee: The Singer Company, Stamford, Conn.

[21] Appl. No.: 944,539

[22] Filed: Sep. 21, 1978

[51] Int. Cl.[2] ..... D05B 3/02

[52] U.S. Cl. ..... 112/158 E; 318/653

[58] Field of Search ..... 112/158 E, 121.11, 121.12, 112/220; 318/647, 653

[56] References Cited

U.S. PATENT DOCUMENTS

| | | | |
|---|---|---|---|
| 3,976,019 | 8/1976 | Allen et al. | 112/158 E |
| 3,984,745 | 10/1976 | Minalga | 112/158 E X |
| 3,988,658 | 10/1976 | Meinke et al. | 318/653 X |

FOREIGN PATENT DOCUMENTS

| | | | |
|---|---|---|---|
| 1440350 | 6/1976 | United Kingdom | 112/158 E |

*Primary Examiner*—Peter P. Nerbun

*Attorney, Agent, or Firm*—William V. Ebs; Robert E. Smith; Edward L. Bell

[57] ABSTRACT

A sewing machine, wherein a stitch controlling instrumentality is positioned during operation of the machine by a motor acting through connecting linkages, is provided with a ring magnet that is connected to said linkages for angular displacement thereby about its axis and with a linear output Hall effect sensor that is disposed within the ring magnet to produce an output voltage proportional to displacement of the stitch forming instrumentality.

8 Claims, 5 Drawing Figures

POSITION SENSING DEVICE FOR ELECTRONIC SEWING MACHINE

BACKGROUND OF THE INVENTION

1. Field of the Invention

The invention is directed to a position sensing device for use in an electronic sewing machine.

2. Background of the Invention

In electronic sewing machines of the type disclosed for example in U.S. Pat. No. 3,984,745 for "Sewing Machine Stitch Pattern Generation Using Servo Controls" and on which preselected stitch patterns may be formed automatically, information related to the positional coordination of the needle penetration for each stitch of each pattern is stored in the machine. The selected information is converted to positional analog signals which control closed-loop servo means including motor means that directly control the positions of stitch forming instrumentalities of the sewing machine to produce a pattern of stitches corresponding to the selected stitch information. Position sensors in the form of linear precision potentiometers have commonly been utilized to provide feed back signals to the motor means indicative of the positions of the stitch forming instrumentalities. However, such potentiometers have not proved to be entirely satisfactory because of the wiper arm in this type of device which must move along a resistance element to produce an output voltage and which after a rather short period of time wears to the point where the device ceases to function reliably.

It is a prime object of the present invention to provide an electronic sewing machine with a position sensor which isn't dependent upon the movement of a wiper arm across a resistance element, and which will function reliably over long periods of time providing a motor that drives stitch forming instrumentalities with feedback signals accurately representing their existing positions.

SUMMARY OF THE INVENTION

In accordance with the invention an electronic sewing machine operable to form preselected stitch patterns, and including motor means and connected linkage means for positioning stitch controlling instrumentalities pursuant to input control signals to the motor means representing desired positions of the stitch controlling instrumentalities is provided with position sensors comprising an associated ring magnet and linear output Hall effect sensor one of which is affixed in the machine and the other of which is connected to the said linkage means for angular displacement about the axis of the ring. The Hall effect sensor is suspended within the ring to produce an output voltage differential which is proportional to said angular displacement and therefor to displacement of the stitch controlling instrumentalities by the motor means acting through the linkage means. Such voltage differential as modified by an adjustable resistor provides a feedback signal in a servo loop used in controlling the motor means.

DESCRIPTION OF THE PREFERRED EMBODIMENT

Figure 1:
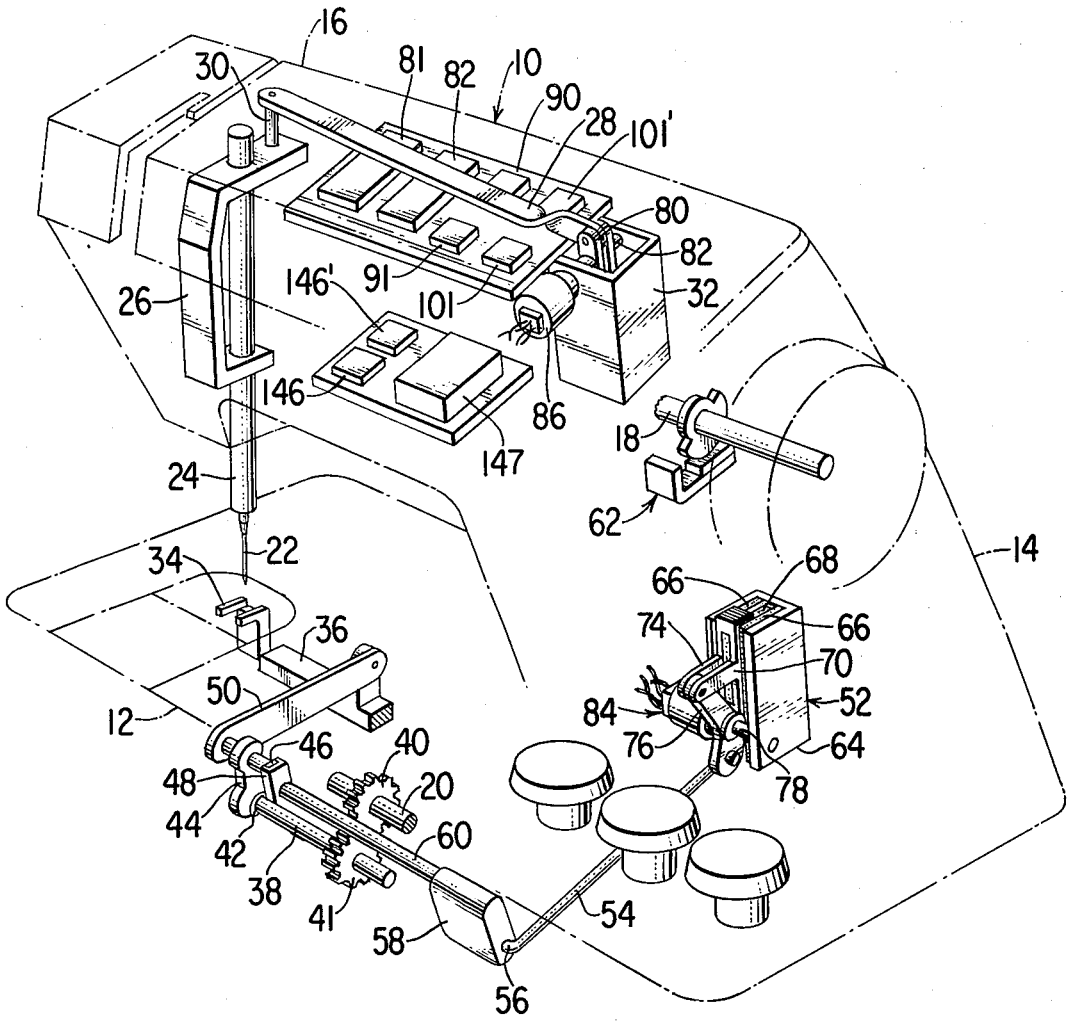
FIG. 1 is a perspective view of a sewing machine including fragments of a typical driving mechanism and of needle jogging and work feeding mechanisms.

Referring to FIG. 1 of the drawings, phantom lines 10 designate the outline of a sewing machine embodying the invention. As shown such sewing machine includes a bed 12, a standard 14 rising from the bed and a bracket arm 16 overhanging the bed. The driving mechanism of the sewing machine includes an arm shaft 18 and a bed shaft 20 interconnected in timed relation by conventional drive mechanism (not shown). A needle 22 is carried for endwise reciprocation by a needle bar 24 mounted for lateral jogging movement in a gate 26 in the bracket arm 16. Conventional connections (not shown) are to be understood as existing between the arm shaft 18 and the needle bar for imparting needle reciprocation. A drive link 28 is pivoted as at 30 on the gate 26 and provides a mechanical connection to an electromechanical actuator 32.

A feed dog 34 is carried by a feed bar 36 as shown, and mechanism is provided for imparting work transporting movement to these parts. Such mechanism includes a feed drive shaft 38 driven by gears 40 and 41 from the bed shaft, a cam 42 on the feed drive shaft, and a pitman 44 embracing the cam 42 and connected to reciprocate a slide block 46 in a slotted feed regulating guideway 48. A link 50 pivotably connects the pitman 44 with the feed bar 36, and the inclination of the guideway 48 determines the magnitude and direction of the feed stroke of the feed dog. Such inclination is controlled by an electromechanical feed actuator 52 which is like the actuator 32. As shown actuator 52 is connected to a link 54 pivoted at 56 on a rock arm 58 that is secured on a rock shaft 60 having the guideway affixed thereto.

The electromechanical actuators 32 and 52 operably connect with control circuitry in integrated circuit modules 81, 82, 90, 91, 101, 101', 146, 146' and 147 which correspond to like numbered modules fully disclosed in the aforesaid U.S. Pat. No. 3,984,745. Such control circuitry includes means for storing and recovering stitch information and includes closed loop servo systems for influencing positional movements of the stitch controlling instrumentalities of the machine, in particular the gate 26 used to influence needle bight and the guideway 48 used to regulate the feed stroke. The control circuitry is associated as shown in the said U.S. Pat. No. 3,984,745 with a pulse generator 62 which operates off arm shaft 18 and is of the type described in U.S. Pat. No. 3,939,372 issued Feb. 17, 1976.

The actuators 32 and 52 are preferably of the kind described in the said U.S. Pat. No. 3,984,745. Referring to the actuator 52, it may be seen as including a U-shaped magnetically permeable yoke 64. Such yoke is affixed in the sewing machine in any suitable manner and has a permanent magnet 66 secured to each of its two inner faces. The permanent magnets 66 are each magnetized across the small dimension to present the same polarity on the opposed inner faces, and a single center leg 68 of magnetically permeable material positioned centrally between the magnets provides both a flux return path and a guide on which there is slidably mounted plastic bobbin 70 that carries a coil 72. The bobbin includes an integral arm 74 movable with the coil. Linear force applied to the wound bobbin 70 and to linkages thereby is proportional to voltage signals applied to the coil 72.

The actuator 52 connects with a link 76 which is affixed to a shaft 78 that is rotatably mounted in the yoke 64 of the actuator. One end of the link 76 is pivotably connected to arm 74 of bobbin 70 and the other end is pivotably connected to link 54.

Actuator 32 is to be understood as being constructed in like fashion to actuator 52. Such actuator 32 connects with a link 80 which is affixed to a shaft 82 that is rotatable in a yoke of the actuator. One end of the link 80 connects with an arm (not shown) of the bobbin of the actuator and the other end pivotably connects with gate driving link 28.

Position sensors 84 and 86 in accordance with the invention are provided for the actuators 52 and 32 respectively. Since these position sensors are identical and each is associated in the same manner with an actuator, only one sensor, namely the sensor 84 and the manner of its association with the actuator 52 is shown and described in detail.

Figure 2:
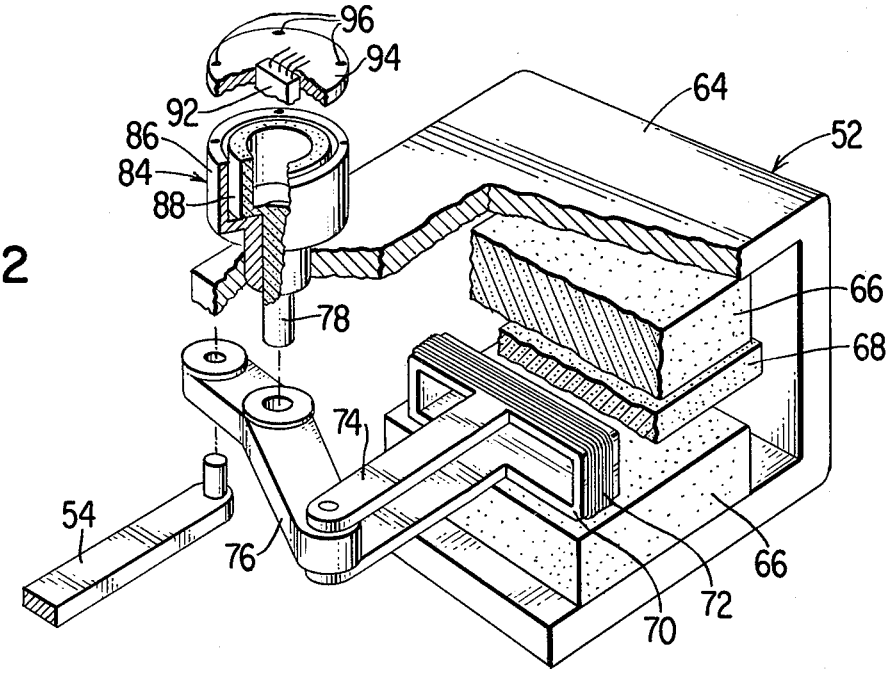
FIG. 2 is a perspective partially exploded view showing a linear actuator and an associated position sensor according to the invention.
Figure 3:
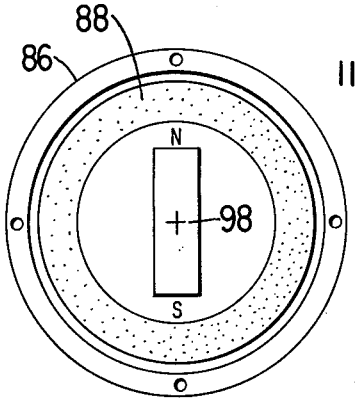
FIG. 3 is a cross-sectional view taken through the position sensor.

As shown in FIG. 2, position sensor 84 includes a cup-like member 86 and a two pole ring magnet 88 having opposed north and south poles on its inner surface. Member 86 is affixed in any suitable manner to the yoke 64 of actuator 52, and magnet 88 is secured to shaft 78 for angular displacement by the shaft as link 76 is moved by the actuator 52. The position sensor further includes a linear output Hall effect sensor 92 of the type shown and described on page II-3 of "Handbook For Applying Solid State Hall Effect Sensors" published by Micro-Switch, a division of Honeywell in 1976. Such Hall effect sensor is affixed to a plate 94 that attaches by screws 96 to the cup-like member 86. The Hall effect device 92 extends within the ring magnet 88 where it is centrally located on the axis 98 of the magnet.

Figure 4:
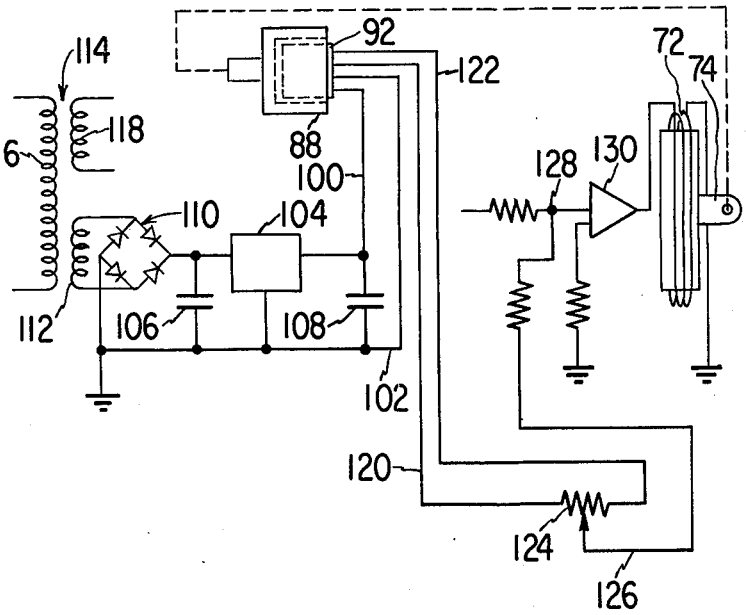
FIG. 4 is a diagram showing input and output circuitry associated with a Hall Effect sensor forming part of the position sensor.
Figure 5:
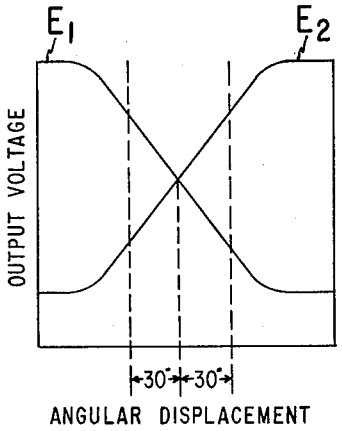
FIG. 5 is a graph indicating the relationship between angular displacement inputs to the position sensor and output voltages generated thereby.

The Hall effect sensor is supplied with a constant D.C. voltage over input lines 100 and 102 by way of suitable circuitry shown as including a voltage regulator 104, condensers 106 and 108, rectifier bridge 110 and secondary windings 112 of a transformer 114 with primary windings 116. The principal power supply of the machine is preferably provided over other secondary windings 118 of the same transformer. Output voltages result in lines 120 and 122 which include an adjustable resistor 124. When the machine is assembled, resistor 124 is set to provide zero voltage in line 126 when the poles of the ring magnet are in alignment with Hall effect sensor 92. The voltages E1 and E2 in output lines 120 and 122 respectively of the Hall Effect Sensor vary linearly as the magnet is angularly displaced from its position of alignment with the Hall effect sensor by the linear actuator within extreme operating limits of the actuator corresponding for example to a 30° displacement of the magnet in either direction as indicated in FIG. 5. The voltage across resistor 124 and the voltage in line 126 therefor also vary linearly throughout the operating range of the actuator. The voltage signal in line 126 is fed back to control circuitry for the linear actuator such as the circuitry fully disclosed in U.S. Pat. No. 3,984,745 and schematically disclosed in FIG. 4 of the attached drawings as including a summing point 128 at which the feedback signal representing the existing position of the linear actuator and a signal representing a desired position are summed to produce an error signal, and including an amplifier 130 to which the error signal is fed and which provides coil 72 with a signal that drives the actuator.

While only particular preferred embodiments of the invention have been shown and described by way of illustration, many modifications will occur to those skilled in the art and it is, therefore to be understood that it is intended herein to cover all such modifications as fall within the true spirit and scope of the invention.

We claim:

1. In a sewing machine, the combination including a linear motor, a stitch controlling instrumentality, linkage means connecting the motor with the stitch controlling instrumentality for positioning said stitch controlling instrumentality in accordance with the operation of the motor, a position sensor including an associated ring magnet and linear output Hall effect sensor one of which is fixed in the machine and the other of which is connected to the linkage means for angular displacement about the axis of the ring, the Hall effect sensor being suspended within the ring magnet to produce an output voltage which is proportional to said angular displacement and therefor to displacement of the stitch controlling instrumentality by the motor acting through the linkage means.

2. The combination of claim 1 wherein the stitch controlling instrumentality is a needle bight influencing gate.

3. The combination of claim 1 wherein the stitch controlling instrumentality is a feed regulating member.

4. The combination of claim 1 wherein the ring magnet is connected to the linkage means for angular displacement and the Hall effect sensor is stationary.

5. The combination of claim 4 wherein the position sensor includes a cup which is fixed in the machine and the ring magnet is angularly movable in the cup.

6. The combination of claim 5 wherein the cup is affixed on the linear motor.

7. The combination of claim 1 including circuit means associated with the Hall effect sensor and provided with adjustable means providing a zero voltage signal in a predetermined position of the ring magnet relative to the Hall effect sensor.

8. The combination of claim 7 wherein the ring magnet includes two oppositely disposed dissimilar poles which are aligned with the Hall effect device in said predetermined position of the ring magnet relative to the Hall effect sensor.

* * * * *